United States Patent [19]

Gherman et al.

[11] Patent Number: 4,823,670

[45] Date of Patent: Apr. 25, 1989

[54] CAPO

[76] Inventors: Steven B. Gherman, 318 N. 13th Street, #2, Allentown, Pa. 18102; David L. Roche, 415 S. St. George St., Allentown, Pa. 18104

[21] Appl. No.: 124,242

[22] Filed: Nov. 23, 1987

[51] Int. Cl.[4] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 775,399 | 11/1904 | Halladay | 84/318 |
| 3,185,012 | 5/1965 | Dunlop | 84/318 |
| 3,823,247 | 7/1974 | Bauerfeind | 84/318 |
| 4,304,165 | 12/1981 | Gould | 84/318 |
| 4,412,472 | 11/1983 | Welch | 84/318 |
| 4,475,433 | 10/1984 | Williamson et al. | 84/318 |

*Primary Examiner*—Lawrence R. Franklin

*Attorney, Agent, or Firm*—Charles H. Lindrooth

[57] ABSTRACT

A capo is disclosed for simultaneously changing pitch of the strings on a musical instrument, such as a guitar. The capo comprises an elongated bar of molded lighweight plastic material formed of polyurethane or the like with a string-engaging pad on an inner surface thereof and a pair of flexible strap portions extending from the bar ends. A clamp integrally molded on the end of one strap portion has a yieldable tooth or latch which interengages with any one of series of closely-spaced serrations disposed lengthwise of the other strap portion. Finger pressure on a projection integral with the latch moves the latch out of engagement with the serrations so that the capo pad can be moved out of engagement with the strings and the capo bar shifted lengthwise of the neck of the guitar to a different pitch position or a wait position adjacent the tuning pegs.

9 Claims, 1 Drawing Sheet

CAPO

FIELD OF THE INVENTION

This invention relates to stringed musical instruments and more particularly to a device for changing the pitch of all of the strings of a fretted stringed instrument such as a guitar, banjo or the like.

BACKGROUND AND PRIOR ART

Devices for simultaneously changing the pitch of the strings of a guitar are commonly terms "capos" and include a bar capable of being held against the strings at various positions between the frets, usually by means of an elastic strap. The strap tension is adjustable by use of a plurality of spaced-apart eyes, two of which fit over projections on the ends of the bar. When not in use, the elastic strap is unfastened and the capo removed from the instrument. Similar capo bars are known wherein the elastic strap is attached to the bar by means of a two- or three-position adjustable locking clamp. When not in use, the capo is removed from the instrument or allowed to hang loosely from the neck of the instrument.

Prior art capos of the kind described are somewhat distracting to a performer and inconvenient to use inasmuch as they require stretching of the elastic strap and searching for the appropriate eyes during a performance. They usually have to be removed from the instrument between uses.

SUMMARY AND OBJECTS OF THE INVENTION

An object of the invention is the provision of a lightweight capo which does not have to be removed from the instrument between uses.

A further object of the invention is the provision of a capo which can slide along the neck of the instrument to any desired position between frets or be positioned above the frets near the tuning pegs between uses.

A still further object of the invention is the provision of a capo which does not tend to fall apart during use.

Another object of the invention is the provision of a capo which is readily and simply adjusted and is not distracting to a performer when the performer needs to change the pitch of all strings of the instrument during use.

Yet another object of the invention is the utilization in a guitar capo of low cost yet durable materials which permit the marketing of the capo as a promotional or advertising item.

The foregoing and other objects and advantages of the invention are provided by a lightweight molded plastic capo bar of generally rectangular shape having flexible molded plastic strap portions extending from each end. One strap portion is provided with an adjustable clasp which interfits with the end of the other strap portion and clamps that strap portion in adjusted position in which the capo bar is pressed against all strings. Preferably, the capo bar is provided with a soft, resilient, sound-dampening pad which presses the strings against the guitar neck when the bar is in the selected adjusted position.

When the capo is not required, the clamp is released and the bar moved to a position adjacent the tuning pegs where it may again be clamped until further needed.

DETAILED DESCRIPTION OF THE INVENTION

Figure 1:
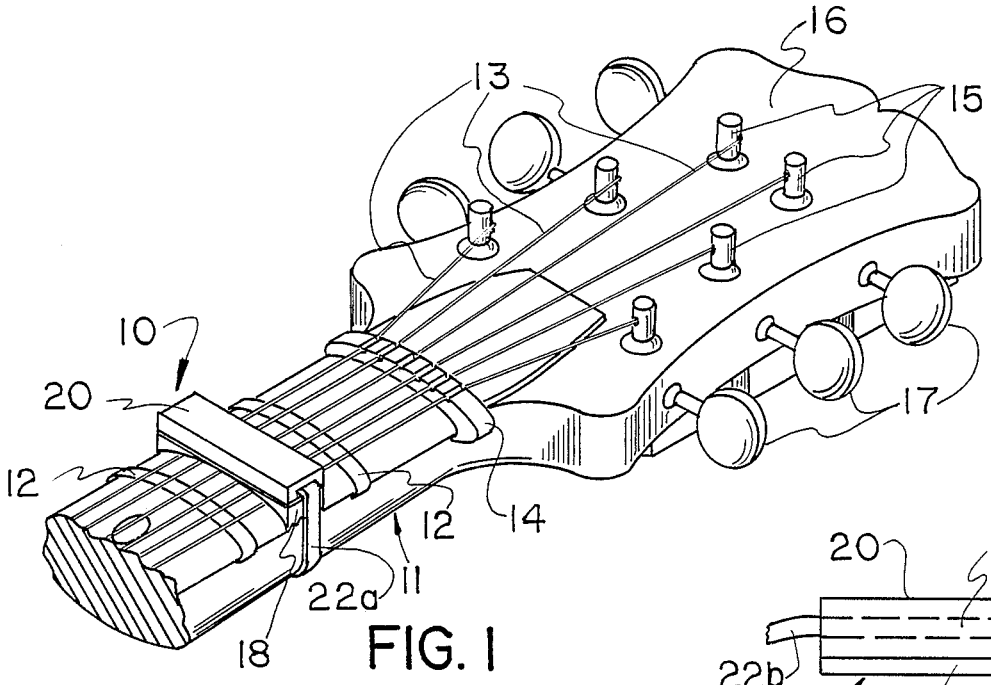
FIG. 1 illustrates a capo bar mounted on the neck of a stringed instrument, such as a guitar.
Figure 1A:
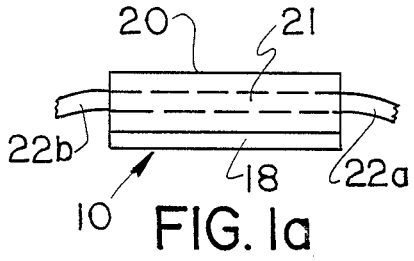
FIG. 1a is a side view of the capo shown in FIG. 1.

A capo 10 made according to the invention is shown positioned on the neck 11 of a guitar between frets 12. As shown in FIG. 1, strings 13 extend lengthwise of the neck over nut 14 and are connected at their upper ends to the tuning pegs 15 which extend through the head 16. As understood in the art, finger pieces 17 individually rotate the tuning pegs and thereby effect tuning of the strings.

Figure 2:
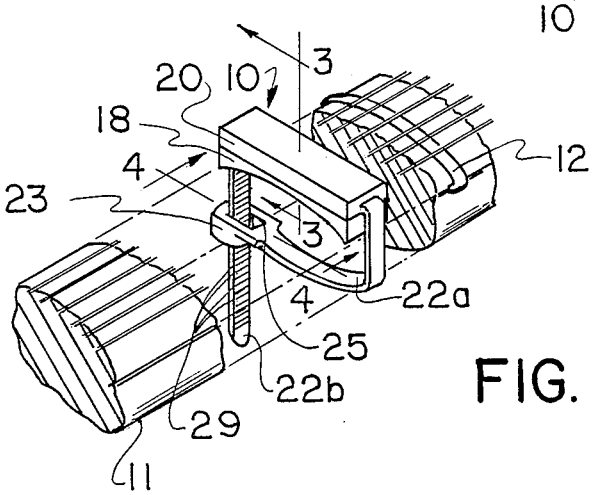
FIG. 2 is a fragmentary view with portions of the neck broken away in order to show the strap fastening means of the capo bar of FIGS. 1 and 1a in an adjusted position.
Figure 3:
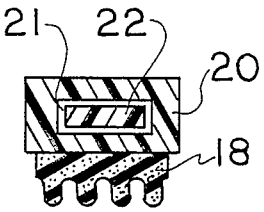
FIG. 3 is a sectional view taken on line 3—3 of FIG. 2.

In accordance with the invention, the capo comprises an elongated, substantially rectangular bar 20 formed of a relatively durable, molded, light, rigid, plastic material, a suitable material being molded polyurethane barstock. A soft resilient pad 18 is provided on one side of bar 20 for clamping the strings against neck 11. Bar 20 is further provided with a longitudinally-extending slot 21 through which a strap 22 extends. Although other materials may be employed, a suitable strap material is comprised of a flexibly molded nylon. Preferably, the strap is comprised of one end portion **22*a* which is provided with an integrally molded clasp-type fastener 23 shown in enlarged sectional view with respect to FIG. 2 in FIG. 4**.

Figure 4:
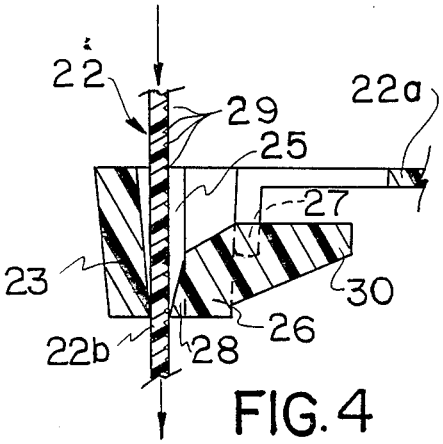
FIG. 4 is a sectional view taken on line 4—4 of FIG. 2.

As seen in FIG. 4, the fastener 23 has a slot 25, which receives the end of strap portion **22*b* so as to form a closed loop with bar 20. The fastener further includes a resiliently mounted clamping member or clasp 26 which is connected to the body of the fastener by resilient connecting portion 27 in a manner in which a tooth or latch 28 resiliently fits into one of a series of closely spaced grooves or serrations 29 which extend lengthwise of the inside surface of strap portion 22*b*. Upon movement of the strap portion 22*b* downwardly as viewed in FIG. 4 in relation to tooth 28, the tooth rides over serrations 29 until the capo bar presses the strings against the guitar neck in the desired position. In order to release tooth 28 from clamping relation with the serrations of strap 22, a projection 30 is depressed with the finger causing flexure of the connecting portions at 27 and sufficient rotation of the tooth 28 to move it away from the serrated surface. The two strap portions may then be separated sufficiently to allow the capo bar to be moved lengthwise of the neck into another position between frets 12 when it is desired to change key or to be positioned in a wait position on top of or immediately adjacent nut 14 when the capo is not needed. In any such position the capo bar may then be clamped in position by pulling on strap end 22*b***.

Capos formed according to the invention are preferably formed of a lightweight and durable plastic material, are inexpensive to manufacture and are adjustable in extremely fine increments. The complications of searching for the appropriate eye and stretching of elastic when used during a performance are avoided. Further, the capo does not have to be removed from the guitar between uses but can be pushed up the neck to a wait position adjacent the tuning pegs until needed again.

We claim:

1. A device for uniformly changing the pitch of the strings extending lengthwise of the fingerboard of a fretted stringed instrument comprisisng a rigid capo bar capable of transversely spanning the fingerboard of the stringed instrument, a pair of flexible strap portions extending outwardly from the ends of said capo bar and adjustable strap fastening means for releasably interconnecting the ends of said strap portions, said strap fastening means having a resilient clasp for clamping said capo bar against the strings at selected lengthwise positions on the fingerboard intermediate said frets for simultaneously changing the pitch of all of said strings, said fastening means comprising transversely-extending grooves spaced lengthwise of one of the strap portions, and wherein said clasp is secured to the other strap portion, a slot in said clasp, said slot being dimensioned to receive said first strap and a latching tooth on said clamp, resilient means biasing said latching tooth towards said grooves for releasably clamping said capo bar onto said strings at positions lengthwise of said fingerboard.

2. A device according to claim 1 further including a soft resilient sound-dampening pad on the side of said capo bar facing said strings.

3. A device according to claim 1, wherein said capo bar is formed of a molded plastic material.

4. A device according to claim 3 wherein said molded plastic material is polyurethane.

5. A device according to claim 1 wherein said capo bar is formed with a slot extending lengthwise thereof and wherein said strap portions comprise extensions of a single piece of flexible plastic strap material passed through said elongated slot.

6. A device for uniformly changing the pitch of the strings extending lengthwise of the fingerboard of a fretted stringed instrument comprising:

a capo bar formed of a rigid, molded plastic material, capable of transversely spanning the fingerboard of the stringed instrument; p1 a soft resilient sound-dampening pad on the side of said capo bar facing said strings;

a pair of flexible strap portions extending outwardly from the ends of said capo bar;

transversely-extending grooves spaced lengthwise of one of the strap portions;

a resilient clasp integrally molded on the end of the other strap portion;

a slot in said clasp, said slot being dimensioned to receive said first strap;

a latching tooth on said clasp, resilient means biasing said tooth towards said grooves in said first strap for releasably interconnecting the ends of said strap portions for clamping said capo bar against the strings at selected lengthwise positions on the fingerboard intermediate said frets.

7. A device according to claim 6 wherein said capo bar is formed with a slot extending lengthwise thereof and wherein said strap portions comprise extensions of a single piece of flexible plastic strap material passed through said elongated slot.

8. A device according to claim 6 wherein said plastic material is polyurethane.

9. A device according to claim 8 wherein said capo bar is formed with a slot extending lengthwise thereof and wherein said strap portions comprise extensions of a single piece of flexible plastic strap material passed through said elongated slot.

* * * * *